US007484957B2

(12) United States Patent
Mersmann et al.

(10) Patent No.: US 7,484,957 B2
(45) Date of Patent: Feb. 3, 2009

(54) BULK MATERIAL COOLER FOR COOLING HOT MATERIALS TO BE COOLED

(75) Inventors: Matthias Mersmann, Lichtenbusch (BE); Karl Schinke, Köln (DE)

(73) Assignee: KHD Humboldt Wedag GmbH, Cologne (DE)

( * ) Notice: Subject to any disclaimer, the term of this patent is extended or adjusted under 35 U.S.C. 154(b) by 105 days.

(21) Appl. No.: 10/579,358

(22) PCT Filed: Nov. 25, 2004

(86) PCT No.: PCT/EP2004/013367

§ 371 (c)(1),
(2), (4) Date: Jan. 12, 2007

(87) PCT Pub. No.: WO2005/052482

PCT Pub. Date: Jun. 9, 2005

(65) Prior Publication Data

US 2007/0128565 A1 Jun. 7, 2007

(30) Foreign Application Priority Data

Nov. 28, 2003 (DE) ..... 103 55 822

(51) Int. Cl.
*F23H 7/08* (2006.01)

(52) U.S. Cl. ..... 432/77; 432/235; 110/281; 198/750.2

(58) Field of Classification Search ..... 432/77, 432/78, 121, 235, 173, 233; 110/281, 268, 110/270; 198/750.1, 750.2, 773
See application file for complete search history.

(56) References Cited

U.S. PATENT DOCUMENTS 4,389,978 A * 6/1983 Northcote ..... 110/281

(Continued)

FOREIGN PATENT DOCUMENTS

DE 3634660 4/1988

(Continued)

OTHER PUBLICATIONS

Schneider et al, Erfahrungen Mit Dem Pyrostep-Rost-Kuehler, 1995, "Experience With The Pyrostep Grate Cooler" publication.

(Continued)

*Primary Examiner*—Gregory A Wilson
(74) *Attorney, Agent, or Firm*—Greer, Burns & Crain LTD

(57) ABSTRACT

The invention aims at providing a bulk material cooler particularly for hot cement clinker, wherein the conveyance performance and the efficiency of the cooler are enhanced and problems due to wear are reduced. According to the invention, the cooling grates of several adjacent, elongated bottom elements extending in longitudinal direction of the cooler are put together, said bottom elements being movably controlled independently of one another between a work clearance stroke position in the direction of conveyance of the material to be cooled and a return stroke position in such a way that the material to be cooled is gradually conveyed through the cooler according to the walking floor transport system, wherein the bottom elements are configured as hollow bodies and enable the cold air to go through yet prevent grate sifting of the material to be cooled.

12 Claims, 1 Drawing Sheet

U.S. PATENT DOCUMENTS

| | | | | |
|---|---|---|---|---|
| 5,310,044 | A * | 5/1994 | Quaeck | 198/750.5 |
| 5,713,345 | A * | 2/1998 | Bentsen et al. | 126/163 R |
| 5,766,001 | A * | 6/1998 | Bentsen | 432/78 |
| 5,788,480 | A * | 8/1998 | Bentsen et al. | 432/78 |
| 5,887,703 | A * | 3/1999 | Meyer et al. | 198/570 |
| 6,312,253 | B1 | 11/2001 | Fons et al. | |
| 6,782,994 | B1 * | 8/2004 | Foster | 198/750.2 |
| 6,848,569 | B1 * | 2/2005 | Foster | 198/750.2 |
| 7,114,612 | B2 | 10/2006 | Meyer et al. | |
| 7,156,223 | B2 | 1/2007 | Meyer et al. | |
| 2003/0126878 | A1 | 7/2003 | Kastingschafer et al. | |
| 2004/0185408 | A1 * | 9/2004 | Staak et al. | 432/77 |
| 2007/0259298 | A1 * | 11/2007 | Splinter et al. | 432/77 |

FOREIGN PATENT DOCUMENTS

| | | |
|---|---|---|
| DE | 196 51 741 | 6/1998 |
| DE | 100 18 142 | 10/2001 |
| DK | 1999-01403 | 4/2001 |
| EP | 0 634 619 | 1/1995 |
| WO | WO 98/48231 | 10/1998 |

OTHER PUBLICATIONS

Walsh F-E "Advances in Reciprocating Grate Coolers", May 1994, publication.

Wedel Von K, "Erfolgreiche Klinkerkuehlung Auf Pendelrosten", 1998, Successful Clinker Cooling on Pendulum Grates.

* cited by examiner

BULK MATERIAL COOLER FOR COOLING HOT MATERIALS TO BE COOLED

BACKGROUND OF THE INVENTION

The invention relates to a bulk material cooler having a cooling grate which carries the material to be cooled, such as hot cement clinker for example, and transports the material to be cooled, through which a cooling gas flows, from the charging end for the material to be cooled to the discharging end for the material to be cooled.

Grate coolers are used in the nonmetallic minerals and ores industry, in order to intensely cool the material previously burned in a furnace, for example cement clinker or other mineral materials, directly following the cooling grate. Apart from traveling grate coolers, widely used for the purpose of transporting the hot material to be cooled over the cooling zone are, in particular, pushing grate coolers, in which the grate system comprises a multiplicity of alternately fixed and movable grate plate supports on which a number of grate plates which are provided with cooling air openings and through which cooling air flows substantially from underneath upward are respectively secured. In this case, rows of fixed plates alternate, seen in the conveying direction, with rows of reciprocating grate plates, which are secured by means of their correspondingly reciprocating grate plate supports on one or more longitudinally movably mounted, driven pushing frames. The common oscillating motion of all the rows of movable grate plates has the effect that the hot material to be cooled is transported in batches and thereby cooled. In this respect, it is also known to prevent the grate plates from being subjected to thermal-mechanical overloading by providing the upper side of the plates with hollows or pockets for receiving and fixing material to be cooled, which then forms a layer providing protection against wear for the hot material to be cooled that slides over it (EP-B-0 634 619).

To avoid the problem of wear in the case of the pushing grate cooler, in the region where adjacent rows of moved and non-moved grate plates overlap, caused by cement clinker abrasion and material becoming lodged in the overlapping region of the grate plates, EP-B-1 021 692 and DE-A-100 18 142 disclose as an alternative to a conventional pushing grate cooler a type of grate cooler in which the cooling grate through which cooling air flows is not moved but stationary, a number of rows of adjacent reciprocating bar-shaped pushing elements, which are moved between a forward-travel position in the transporting direction of the material to be cooled and a return-travel position, being arranged above the stationary grate surface transversely in relation to the transporting direction of the material to be cooled, so that the reciprocating motion of these pushing elements in the bed of material to be cooled has the effect that the material is successively moved from the beginning of the cooler to the end of the cooler and is thereby cooled. As a result of the highly stressed pushing elements that are moved in the bed of bulk material, the bed of bulk material is intermixed, which has unfavorable effects on the thermal efficiency of this type of cooler. The bulk material conveying capacity is thereby decisively influenced by the difference between the volume of cement clinker that is moved with each forward travel in the conveying direction and the volume of clinker that is moved undesirably counter to the conveying direction in the return-travel movement. Furthermore, in the case of this known type of grate cooler, the pushing elements in the form of transverse bars are secured on the upper side of vertical drive plates, which are aligned in the longitudinal direction of the cooler, extend through corresponding longitudinal slits of the cooling grate and are driven from underneath the cooling grate. It goes without saying that it is arduous to seal the cooling grate loaded with material to be cooled in such a way as to prevent material falling through the grate at the locations where the drive plates pass through, and thereby keep the amount of material wear that occurs within limits.

Finally, DE-A-196 51 741 discloses a cooling tunnel for cooling and/or freezing material to be cooled by means of cold air by using the so-called "walking floor" conveying principle, in which a number of adjacently arranged bottom elements of the cooling tunnel are moved forward together in the transporting direction but are not moved back together but separately from one another. A high pile of bulk material is intended to form over the bottom elements, filling the entire cross section of the cooling tunnel, so that the cooling gas flows in countercurrent through the bulk material that is moved step by step. The bottom elements themselves remain uncooled by the cooling gas, so that for this reason alone the known cooling tunnel would not be suitable for cooling red hot cement clinker falling from the discharge end of a rotary kiln. The direct contact of the fresh hot cement clinker with the surface of the bottom elements would lead to high thermal-mechanical loading in terms of wear and therefore to an inadequate service life of such a cooling tunnel in the case of hot cement clinker.

SUMMARY OF THE INVENTION

The invention is based on the object of providing a bulk material cooler, in particular for hot cement clinker, the conveying capacity, the service life and the efficiency of the cooler being increased and the problems concerning wear being reduced.

This object is achieved according to the invention by a bulk material cooler.

A bulk material cooler having a cooling grate which carries the material to be cooled and transports the material to be cooled, through which a cooling gas flows from the charging end for the material to be cooled to the discharging end for the material to be cooled, wherein the cooling grate is made up of a number of adjacently arranged elongate bottom elements which extend in a longitudinal direction of the cooler, are movable in a controlled manner at least partly independently of one another between a forward-travel position in the transporting direction of the material to be cooled and a return-travel position so that the material to be cooled is conveyed through the cooler step by step in accordance with the walking floor conveying principle; the bottom elements have, seen in cross section, an upper side which carries the material to be cooled and allows the cooling gas to pass through from underneath upward, and, at a distance from said upper side, a closed underside preventing material to be cooled from falling through the grate; and the underside of the bottom elements has a number of cooling-gas inlet openings distributed over the length, to aerate the bottom elements and consequently the cooling grate.

In the case of the bulk material cooler according to the invention, the cooling grate carrying the hot material to be cooled is made up of a number of adjacently arranged elongate bottom elements which extend in the longitudinal direction of the cooler, are movable in a controlled manner at least partly independently of one another between a forward-travel position in the transporting direction of the material to be cooled and a return-travel position, so that the material to be cooled is conveyed through the cooler step by step in accordance with the walking floor conveying principle. In this case, the cooling grate put together in this way allows the cooling air to pass through, flowing for instance in transverse current from underneath upward through the cooling grate and the bed of bulk material kept on it, i.e. the bottom elements serve at the same time as bulk-material transporting elements and as cooling-grate aerating elements. Pushing elements that are moved above the cooling grate in the bed of bulk material, which would be subjected to particularly high wear and would intermix the bed of bulk material, are not present. It is specified as an example that the bottom elements are moved forward together in their forward-travel movement, but are not moved back together in their return-travel movement, but successively in at least two groups in at least two consecutive steps, in which only some of the bottom elements, for example in each case only every second bottom element seen over the width of the cooler, is moved back each time. In their return-travel movement, the bottom elements are withdrawn in a controlled manner under the resting bed of bulk material in such a way that the bed of bulk material remains at rest and does not move in sympathy with the return-travel movement.

The individual bottom elements of the bulk material cooler according to the invention, which are movable in a controlled manner, are formed in a way similar to an elongate hollow body profile and they have, seen in cross section, an upper side which carries the material to be cooled and allows the cooling gas to pass through from underneath upward, and, at a distance from said upper side, a closed underside preventing material to be cooled from falling through the grate. In this case, the underside of all the bottom elements has a number of cooling-gas inlet openings, distributed over the length, to aerate the bottom elements and consequently the cooling grate. The driving of the bottom elements, to move them between their forward-travel position and their return-travel position, takes place from underneath the cooling grate.

In order that the upper side of the bottom element allows the cooling gas to pass through, the upper sides of the cooling elements that carry the material to be cooled may be provided with some kind of perforations. According to one particular feature of the invention, the upper sides of the bottom elements that are longitudinally movable individually and/or in groups may in each case comprise gabled-roof-shaped V profiles arranged spaced apart mirror-symmetrically opposite one another, but offset in relation to one another, the V legs of which engage in one another with an intermediate space, which latter forms a labyrinth for the material to be cooled and for the cooling air, that is to say the labyrinth formed in this way allows the cooling air to pass through but at the same time prevents material to be cooled from falling down through the grate.

To reduce the wear between the surface of the upper sides of the bottom elements carrying the material to be cooled, webs lying transversely in relation to the transporting direction of the material to be cooled may be arranged on these upper sides to fix the lowermost layer of bulk material and to avoid relative movement of this lowermost layer and the bottom element, that is to say that, during the operation of the bulk material cooler according to the invention, a relative movement only takes place between the fixed lowermost layer of bulk material and the bed of bulk material located over it.

According to a further feature of the invention, respectively overlapping longitudinal webs may be arranged on the opposite longitudinal sides of the adjacent bottom elements that are movable in a controlled manner, with a horizontal sealing gap tending toward zero being formed in each case, thereby preventing cooling air from passing through in the region between adjacent bottom elements. This horizontal seal operates without scavenging air and it may be formed in a self-adjusting manner with assistance provided by a spring force, which always brings the horizontal sealing gap toward zero.

Seen over the length and over the width of the cooler, the cooling grate of the bulk material cooler according to the invention is advantageously made up of a number of bottom element modules, the bottom element modules that are arranged one behind the other in the transporting direction of the material to be cooled being coupled in such a way that the coupling elements of the bottom element modules lying one behind the other respectively of a row are subjected in particular only to tensile stress.

In the case of the grate cooler according to the invention, the conveying mechanism for transporting the material to be cooled is completely independent of the aeration of the cooling grate. The movement of the bottom elements individually or in groups may also be used for the purpose of distributing the bulk material, such as hot cement clinker for example, in a specific manner on the cooling grate.

BRIEF DESCRIPTION OF THE DRAWINGS

The invention and its further features and advantages are explained in more detail on the basis of the exemplary embodiments that are schematically represented in the figures, in which.

DETAILED DESCRIPTION OF THE PREFERRED EMBODIMENTS

Figure 1:
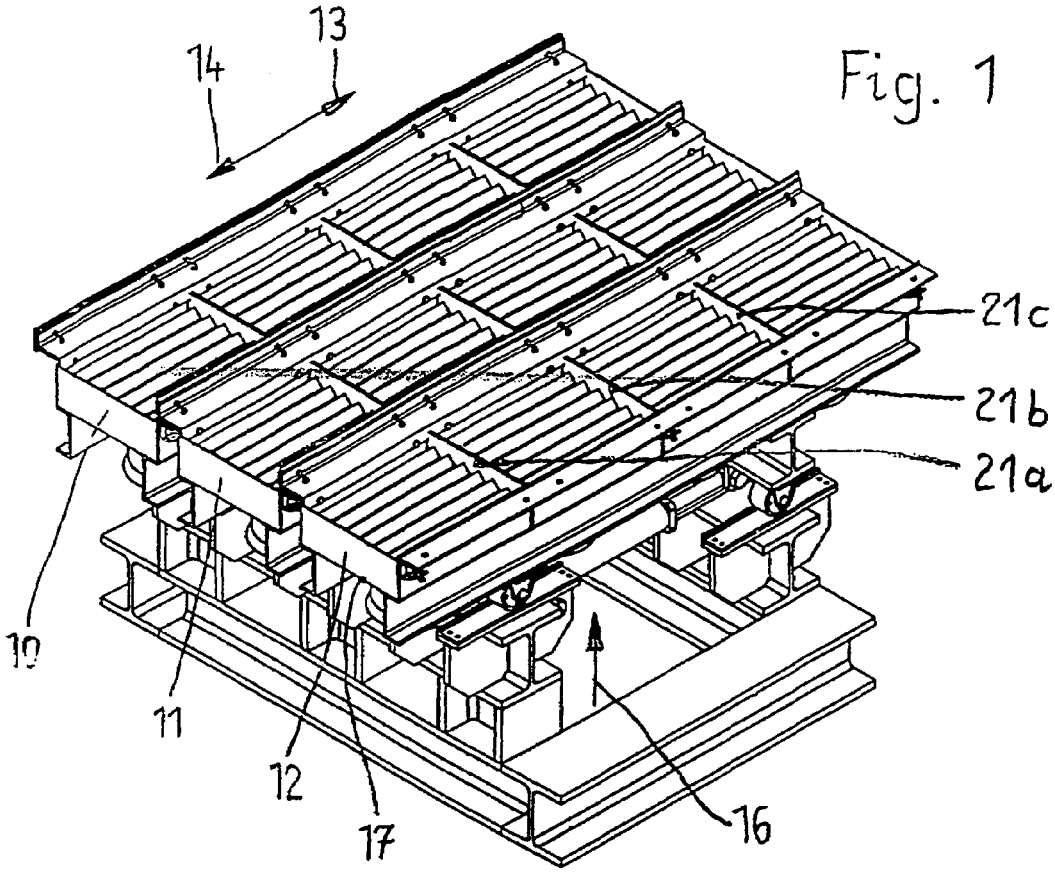
FIG. 1 shows in a perspective view a bottom element module, the cooling grate of the bulk material cooler according to the invention being made up of a multiplicity of such modules arranged one behind the other and adjacent one another.
Figure 2:
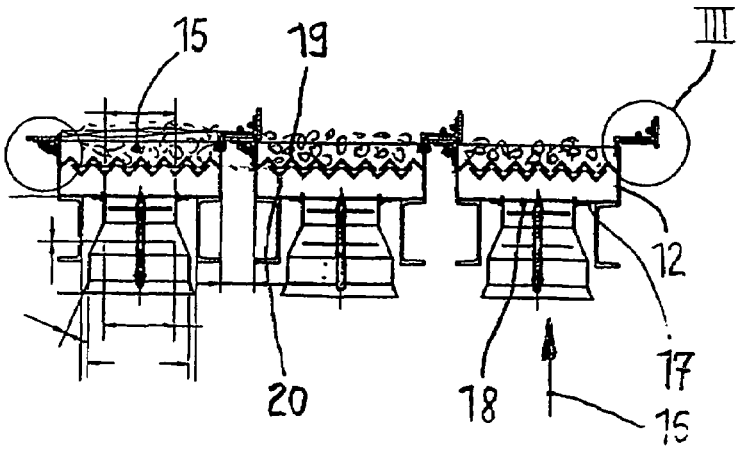
FIG. 2 shows a cross section through the module of FIG. 1 transversely in relation to its direction of movement.

Explained on the basis of the module of FIG. 1, the cooling grate of the bulk material cooler according to the invention is made up of a number, for example three per module, of elongate, approximately trough-shaped bottom elements 10, 11, 12, which extend in the longitudinal direction of the cooler, are arranged adjacent one another and are movable in a controlled manner independently of one another between a forward-travel position 13 in the transporting direction of the material to be cooled and a return-travel position 14, so that the material to be cooled 15 that is kept on the bottom elements and is indicated in FIG. 2 is conveyed through the cooler step by step in accordance with the walking floor conveying principle. As indicated in FIG. 1 in the case of the bottom element 12, the driving of the individual bottom elements 10, 11, 12 of the bottom element modules takes place from underneath the cooling grate by means of pushing frames, which are supported on running rollers and on which actuating cylinders act.

The bottom elements 10, 11, 12 of all the modules are formed as hollow bodies, to be specific they have, seen in cross section, an upper side which carries the material to be cooled 15 and allows the cooling air 16 to pass through from underneath upward, and, at a distance from said upper side, a closed underside 17 preventing material to be cooled from falling through the grate. In this case, the undersides 17 of all the bottom elements have a number of cooling-air inlet openings 18, distributed over the length, for the inlet of the cooling air 16 to aerate the bottom elements and cool the bulk material that is kept on it. The upper sides of the bottom elements may be provided with some kind of perforations allowing the cooling air 16 to pass through. As can be seen in the exemplary embodiment of FIG. 2, the upper sides of the longitudinally movable bottom elements 10, 11, 12 may particularly advantageously in each case comprise gabled-roof-shaped V profiles 19, 20 arranged spaced apart mirror-symmetrically opposite one another, but offset in relation to one another, the V legs of which engage in one another with an intermediate space, which latter forms a labyrinth for the material to be cooled 15 and for the cooling air 16. As a result, it is ensured that the bulk material cooler according to the invention is protected against material falling through the grate.

Webs 21*a*, 21*b*, 21*c*, lying transversely in relation to the transporting direction of the material to be cooled, are advantageously arranged on the upper side of the bottom elements 10 to 12 to fix the lowermost layer of bulk material and to avoid relative movement of this lowermost layer and the respective bottom element, which contributes to protecting these bottom elements against wear.

Figure 3:
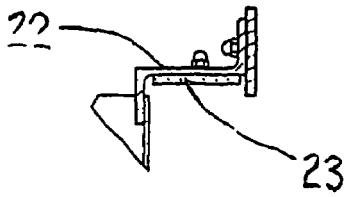
FIG. 3 shows the detail III of FIG. 2 taken as an enlarged extract.

The drawing of the detail in FIG. 3 shows that, to seal the intermediate space between the adjacent bottom elements that can be moved in a controlled manner, respectively overlapping longitudinal webs, to be specific upper longitudinal web 22 and lower longitudinal web 23, are arranged on the opposite longitudinal sides of the adjacent bottom elements, with a horizontal sealing gap tending toward zero being formed in each case. This horizontal seal operates without scavenging air and it may be formed in a self-adjusting manner by using a spring force.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A bulk material cooler having a cooling grate which carries material to be cooled and transports the material to be cooled, through which a cooling gas flows, from a charging end for the material to be cooled to a discharging end for the material to be cooled, wherein the cooling grate is made up of a number of adjacently arranged elongate bottom elements which extend in a longitudinal direction of the cooler, are movable in a controlled manner at least partly independently of one another between a forward-travel position in a transporting direction of the material to be cooled and a return-travel position so that the material to be cooled is conveyed through the cooler step by step in accordance with the walking floor conveying principle;

the bottom elements have, seen in cross section, an upper side which carries the material to be cooled and allows the cooling gas to pass through from underneath upward, and, at a distance from the upper side, a closed underside preventing material to be cooled from falling through the grate; and the underside of the bottom elements has a number of cooling-gas inlet openings distributed over the length, to aerate the bottom elements and consequently the cooling grate;

wherein the upper sides of the bottom elements that are longitudinally movable in each case comprise gabled-roof-shaped V profiles arranged spaced apart mirror-symmetrically opposite one another, but offset in relation to one another, such that an upper set of V profiles are inverted with two leas of the V completely overlying upwardly extending legs of two adjacent V profiles of a lower set, the V legs of the two sets of profiles engaging one another with an intermediate space, which latter forms a labyrinth for the material to be cooled and for the cooling gas.

2. The bulk material cooler as claimed in claim 1, wherein webs lying transversely in relation to the transporting direction of the material to be cooled are arranged on the upper side of the bottom elements to fix the lowermost layer of bulk material and to avoid relative movement of this lowermost layer and the bottom element.

3. The bulk material cooler as claimed in claim 1, wherein webs lying transversely in relation to the transporting direction of the material to be cooled are arranged on the upper side of the bottom elements to fix the lowermost layer of bulk material and to avoid relative movement of this lowermost layer and the bottom element.

4. The bulk material cooler as claimed in claim 1, wherein, seen over a length and over a width of the bulk material cooler, the cooling grate is made up of a number of bottom element modules, the bottom element modules respectively of a row are arranged and coupled one behind the other in the transporting direction of the material to be cooled.

5. The bulk material cooler as claimed in claim 4, wherein a driving of the individual bottom elements of the bottom element modules, to move them between the forward-travel position and the return-travel position takes place from underneath the cooling grate, the driving taking place in such a way that the connecting elements of the bottom element modules lying one behind the other respectively of a row being subjected in particular only to tensile stress.

6. A bulk material cooler having a cooling grate which carries material to be cooled and transports the material to be cooled, though which a cooling gas flows, from a charging end for the material to be cooled to a discharging end for the material to be cooled, wherein the cooling grate is made up of a number of adjacently arranged elongate bottom elements which extend in a longitudinal direction of the cooler, are movable in a controlled manner at least partly independently of one another between a forward-travel position in a transporting direction of the material to be cooled and a return-travel position so that the material to be cooled is conveyed through the cooler step by step in accordance with the walking floor conveying principle;

the bottom elements have, seen in cross section, an upper side which carries the material to be cooled and allows the cooling gas to pass though from underneath upward, and, at a distance from the upper side, a closed underside preventing material to be cooled from falling through the grate; and the underside of the bottom elements has a number of cooling-gas inlet openings distributed over the length, to aerate the bottom elements and consequently the cooling grate;

wherein overlapping longitudinal webs with horizontal overlapping areas are arranged on the opposite longitudinal sides of the adjacent bottom elements that are movable in a controlled manner, with a horizontal sealing gap tending toward zero being formed in each case.

7. A bulk material cooler, having a cooling grate through which a cooling gas flows, which carries material to be cooled and transports the material to be cooled from a charging end to a discharging end, wherein the cooling grate comprises a plurality of adjacently arranged elongate bottom elements which extending along a length in a longitudinal direction of the cooler, are movable in a controlled manner at least partly independently of one another between a forward-travel position in the transporting direction of the material to be cooled and a return-travel position;

the bottom elements have an upper side which carries the material to be cooled and allows the cooling gas to pass through from underneath upward, and, at a distance from the upper side, a closed underside preventing material to be cooled from falling through the grate; and the underside of the bottom elements has a number of cooling-gas in let openings distributed over the length, to aerate the bottom elements and consequently the cooling grate;

wherein the upper sides of the bottom elements comprise gabled-roof-shaped V profiles arranged spaced apart mirror-symmetrically opposite one another, but offset in relation to one another, such that an upper set of V profiles are inverted with two legs of the V completely overlying upwardly extending legs of two adjacent V profiles of a lower set, the V legs of the two sets of profiles engaging one another with an intermediate space, which latter forms a labyrinth for the material to be cooled and for the cooling gas.

8. The bulk material cooler of claim 7, wherein webs lying transversely to the transporting direction of the material to be cooled are arranged on the upper side of the bottom elements to positionally fix a lowermost layer of bulk material and to avoid relative movement between this lowermost layer and the bottom element.

9. The bulk material cooler of claim 7, wherein webs lying transversely to the transporting direction of the material to be cooled are arranged on the upper side of the bottom elements to positionally fix the lowermost layer of bulk material and to avoid relative movement between this lowermost layer and the bottom element.

10. The bulk material cooler of claim 7, wherein, over the length and the width of the bulk material cooler, the cooling grate is made up of a plurality of bottom element modules, the bottom element modules of a row arranged one behind the other in the transporting direction of the material to be cooled being coupled.

11. The bulk material cooler of claim 10, wherein a driving of the individual bottom elements of the bottom element modules, to move them between the forward-travel position and the return-travel position, takes place from underneath the cooling grate, the driving taking place in such a way that connecting elements of the bottom element modules lying one behind the other of a row being subjected only to tensile stress.

12. A bulk material cooler, having a cooling grate through which a cooling gas flows, which carries material to be cooled and transports the material to be cooled from a charging end to a discharging end, wherein the cooling grate comprises a plurality of adjacently arranged elongate bottom elements which extending along a length in a longitudinal direction of the cooler, are movable in a controlled manner at least partly independently of one another between a forward-travel position in the transporting direction of the material to be cooled and a return-travel position;

the bottom elements have an upper side which carries the material to be cooled and allows the cooling gas to pass through from underneath upward, and, at a distance from the upper side, a closed underside preventing material to be cooled from falling through the grate; and the underside of the bottom elements has a number of cooling-gas inlet openings distributed over the length, to aerate the bottom elements and consequently the cooling grate;

wherein overlapping longitudinal webs with horizontal overlapping areas are arranged on opposite longitudinal sides of the adjacent bottom elements, with a horizontal sealing gap tending toward zero being formed in each case.

* * * * *